US010464645B2

(12) United States Patent
Jamieson

(10) Patent No.: US 10,464,645 B2
(45) Date of Patent: Nov. 5, 2019

(54) ADJUSTING THE BUOYANCY OF UNMANNED UNDERWATER VEHICLES

(71) Applicant: Subsea 7 Limited, Sutton (GB)

(72) Inventor: James Andrew Jamieson, Balmedie (GB)

(73) Assignee: Subsea 7 Limited, Sutton (GB)

( * ) Notice: Subject to any disclaimer, the term of this patent is extended or adjusted under 35 U.S.C. 154(b) by 64 days.

(21) Appl. No.: 15/575,807

(22) PCT Filed: May 13, 2016

(86) PCT No.: PCT/GB2016/051392

§ 371 (c)(1),
(2) Date: Nov. 20, 2017

(87) PCT Pub. No.: WO2016/185185

PCT Pub. Date: Nov. 24, 2016

(65) Prior Publication Data

US 2018/0186438 A1 Jul. 5, 2018

(30) Foreign Application Priority Data

May 21, 2015 (GB) ..... 1508714.1

(51) Int. Cl.
*B63G 8/00* (2006.01)
*B63G 8/22* (2006.01)

(52) U.S. Cl.
CPC ..... *B63G 8/22* (2013.01); *B63G 8/001* (2013.01); *B63G 2008/002* (2013.01); *B63G 2008/008* (2013.01)

(58) Field of Classification Search
CPC ... B63G 8/14; B63G 8/22; B63G 8/24; B63G 2008/008; B63G 2008/004
See application file for complete search history.

(56) References Cited

U.S. PATENT DOCUMENTS 3,716,009 A 2/1973 Strickland
4,448,145 A * 5/1984 Hervieu ..... B63C 11/34 114/312

(Continued)

FOREIGN PATENT DOCUMENTS

AU 2007202031 11/2008
EP 2 412 626 2/2012

(Continued)

*Primary Examiner* — Andrew Polay
(74) *Attorney, Agent, or Firm* — Levy & Grandinetti

(57) ABSTRACT

A method of adjusting buoyancy of an Unmanned Underwater Vehicle (UUV) includes measuring buoyancy drift of the UUV when underwater. After docking the UUV with a subsea station, a quantity of a flowable buoyancy-adjustment material held onboard the UUV is changed by transferring that material from the station to the UUV or from the UUV to the station. A buoyancy adjustment system for a UUV includes: an onboard tank for holding a variable quantity of the buoyancy-adjustment material and upwardly-opening and downwardly-opening passageways communicating with the tank for transferring the buoyancy-adjustment material to or from the UUV. The subsea station includes: a dock for docking a UUV; a holding tank for holding the buoyancy-adjustment material; and at least one upwardly-opening or downwardly-opening passageway aligned with the dock and communicating with the holding tank for transferring the buoyancy-adjustment material to or from the docked UUV.

43 Claims, 10 Drawing Sheets

(56) References Cited

U.S. PATENT DOCUMENTS

| | | | | |
|---|---|---|---|---|
| 6,142,092 | A * | 11/2000 | Coupland | B63B 22/18 114/331 |
| 7,213,532 | B1 * | 5/2007 | Simpson | B63C 11/42 114/331 |
| 8,109,223 | B2 * | 2/2012 | Jamieson | B63G 8/001 114/312 |
| 8,997,678 | B2 * | 4/2015 | Spickermann | B63C 7/08 114/326 |
| 2012/0289103 | A1 * | 11/2012 | Hudson | F42B 19/00 440/38 |

FOREIGN PATENT DOCUMENTS

| | | |
|---|---|---|
| GB | 2 351 718 | 1/2001 |
| GB | 2 448 918 | 11/2008 |
| GB | 2466377 | 6/2010 |

* cited by examiner

ADJUSTING THE BUOYANCY OF UNMANNED UNDERWATER VEHICLES

This invention relates to the operation of unmanned underwater vehicles (UUVs). The invention is particularly concerned with adjusting the buoyancy of UUVs to mitigate buoyancy drift while they remain deep underwater for long periods.

It is often necessary to perform tasks such as inspection, monitoring, maintenance and construction during subsea operations. Below diver depth, such tasks are routinely performed by UUVs, in particular remotely-operated vehicles (ROVs) and autonomous underwater vehicles (AUVs).

ROVs are characterised by a physical connection to a surface support vessel via an umbilical tether that carries power and data including control signals. They are typically categorised as either work-class ROVs or inspection-class ROVs.

Work-class ROVs are large and powerful enough to perform a variety of subsea maintenance and construction tasks, for which purpose they may be adapted by the addition of specialised skids and tools in a modular, interchangeable fashion. Such tools may, for example, include torque tools and reciprocating tools driven by hydraulic or electric motors or actuators.

Inspection-class ROVs are smaller but more manoeuvrable than work-class ROVs to perform inspection and monitoring tasks, although they may also perform light maintenance tasks such as cleaning using suitable tools. In addition to visual inspection using lights and cameras, inspection-class ROVs may hold sensors in contact with, or in proximity to, a subsea structure such as a pipeline to inspect and monitor its condition or other parameters.

AUVs are autonomous, robotic counterparts of ROVs. AUVs are mainly used like inspection-class ROVs to perform subsea inspection and monitoring tasks. However, AUVs have been used or proposed for subsea intervention tasks like those performed by work-class ROVs. AUVs that are capable of subsea intervention tasks may be referred to as autonomous intervention vehicles or AIVs. The generic term 'AUV' will be used in this specification for simplicity.

AUVs move from task to task on a programmed course without a physical connection to a support facility such as a surface support ship. They have large on-board batteries for adequate endurance but must make frequent trips to the surface or to a subsea basket, garage or docking station for battery recharging.

As recharging an AUV at the surface is a complex and time-consuming task that ties up a surface support vessel, there has been a trend in the art to host AUVs subsea. Subsea hosting involves recharging an AUV at a subsea base such as a basket, garage or docking station, to which the AUV returns periodically between tasks. An AUV may also be reprogrammed at such a subsea base to perform different tasks from time to time.

To support subsea hosting, a set of tools or sensors may be stored in a deployment basket that is lowered to near a subsea work site. A subsea-hosted AUV can then fetch and carry the appropriate tool or sensor from the deployment basket to the work site.

Thus hosted and supported, AUVs are capable of underwater missions of very long duration. Indeed, continuous missions as long as six months or more are now contemplated for subsea-hosted AUVs.

Being compact, UUVs such as AUVs are generally designed to have permanent onboard buoyancy. Typically the permanent buoyancy is provided by permanently buoyant elements such as buoyancy blocks of syntactic foam that are attached to or built into the UUV. Usually such blocks are situated near the top of the UUV to enhance stability. The objective of the permanent buoyancy is for the UUV to have substantially neutral buoyancy over a planned range of working depths.

Substantially neutral buoyancy is beneficial so that a UUV can hold station accurately in mid-water over a desired working depth range without excessive use of its thrusters. Thus, apart from driving horizontal movement of the UUV on the x- and y-axes, the thrusters should be used principally to change depth on the z-axis in the working depth range, rather than to maintain depth. The same thrusters can be used for x-/y- and z-axis movement, or those functions can be split between different thrusters. It is particularly desirable to be able to hold station near the seabed without thrusting up against negative buoyancy, as downwash from thrusters tends to stir up sediment.

Slight positive buoyancy is also an option for a UUV as this allows station-holding without thrusting up, and as the UUV will rise slowly to the surface in the event of power failure. However, in some circumstances, there may be an advantage in temporarily conferring negative buoyancy on a UUV. Examples are when diving in high current situations or when performing bottom-crawling operations on the seabed or on a subsea structure, such as repairing a pipeline or cable.

In this context, negative buoyancy means that the weight of the UUV in water exceeds buoyant upthrust, whereas positive buoyancy means that buoyant upthrust exceeds the weight of the UUV in water.

Longer continuously-underwater missions encounter the problem that the buoyancy performance of an UUV tends to decrease with time of immersion. For example, buoyancy blocks immersed in deep water for long periods may suffer water absorption and shrinkage due to creep under hydrostatic pressure and changes in temperature.

For these and other reasons, the level of permanent buoyancy—whose value should be a known constant—becomes unpredictably variable. Thus, the buoyancy of a UUV is likely to change or drift over months of continuous submergence. The resulting buoyancy change makes control of the UUV difficult and manifests itself in excessive use of the thrusters to maintain a desired depth. This problem is particularly acute in the great water depths in which long-term subsea hosting of AUVs is most advantageous.

It is known to fit a variable-buoyancy system to a submersible vehicle such as a UUV. For example, oil or gas may be pumped into a bladder or bellows from a pressure vessel.

Some known variable-buoyancy systems are akin to the ballasting systems used to control the depth of submarines, in that water enters the system to decrease buoyancy and a gas expels water from the system to increase buoyancy. However, such systems require a power source and active equipment such as pumps. Also, managing gas in deep and very deep water requires bulky pressure vessels and piping because of the effects of hydrostatic pressure.

A simpler variable-buoyancy system is also known in which additional pressure for expelling water and compensating the loss of permanent buoyancy is generated by a pressure accumulator. Pressure is maintained in the accumulator by hydraulic pressure derived from the hydraulic circuit of the UUV.

All known variable-buoyancy systems are heavy, complex and not particularly effective. For example, they incorporate hydraulic interfaces that may give rise to leaks.

GB 2351718 discloses a buoyancy compensator. This is irrelevant other then as background art because the role of such compensators is to provide instantaneous compensation of buoyancy or volume changes caused by rapid changes in hydrostatic pressure and water density. Such compensators generally employ a closed system comprising a pressure tank and a bellows arrangement. They are functionally equivalent to a ballast adjustment system with pressure compensation, as the bellows acts in the same way as the bladder of a pressure compensator.

U.S. Pat. No. 3,716,009 discloses a variable buoyancy control system for a diver-operated underwater vehicle. The system is far too complex for a compact UUV in which operational depth changes are effected by thrusters rather than by varying ballasting.

U.S. Pat. No. 7,213,532 discloses techniques for refilling a gas ballasting system that controls the depth of an ROV. The ROV has an onboard gas tank whose capacity allows a limited number of depth changes. Once the onboard gas tank is empty, a suspended gas supply tank is lowered from a surface vessel and docked to the ROV underwater so that gas can be transferred from the gas supply tank to the onboard gas tank.

Again, the system disclosed in U.S. Pat. No. 7,213,532 suffers from the difficulty of storing and handling gas at the high pressure necessary to counter hydrostatic pressure at great depth. Frequent refilling is required and gas transfer must be supported and controlled from the surface, which ties up the surface vessel. This may not matter so much for an ROV that is tethered to a surface vessel but it is contrary to the purpose of an AUV, which is to be independent of continuous surface support. Also, it is challenging to achieve docking of the supply tank with the ROV and to manage the docked phase during gas transfer. The docked assembly could swing and accidentally undock, either because of water dynamics or because the relative weights of the ROV and the supply tank will change during gas transfer.

GB 2466377 aims to achieve fine management of buoyancy of a subsea load by balancing the upthrust of permanent positive buoyancy against the weight of a dense ballasting fluid. The ballasting fluid passes along a subsea umbilical between a reservoir on a surface vessel and a buoyancy chamber attached to the subsea load. The net buoyancy of the buoyancy chamber is adjusted either by filling the chamber with ballasting fluid from the reservoir or by returning the ballasting fluid from the chamber to the reservoir.

Again, disadvantageously, GB 2466377 ties the subsea load to the surface vessel by the umbilical and also by a lifting wire suspended from a crane of the vessel. Also, achievement of neutral buoyancy relies on the dense ballasting fluid being contained and securely held: if that fluid leaks, the positively buoyant load could shoot up to the surface uncontrollably and dangerously.

GB 2466377 also teaches adjusting the trim of an ROV tethered to a surface vessel. To do so, the ROV transfers a dense ballasting fluid between onboard trimming chambers. In this respect, there is no teaching of transferring ballasting fluid to or from the ROV as a whole, only from one location to another on board the ROV. This is one of various proposals in the prior art to change the pitch and trim of a UUV by displacing liquid or solid ballast, for example between the bow and stern of the UUV. As none of those techniques can change the overall buoyancy of a UUV, they cannot combat the problem of buoyancy drift.

Against this background, the invention aims to provide a simple solution for adjusting buoyancy during a long-term underwater stay of an UUV, especially an AUV. The invention takes advantage of the presence of subsea bases such as baskets, garages or docking stations to which the AUV returns for battery recharging.

In outline, in one sense, the invention resides in a method of adjusting the buoyancy of a UUV during a subsea mission. The method comprises measuring buoyancy drift of the UUV when under water and docking the UUV with a subsea station. Buoyancy drift may be measured before docking the UUV with the subsea station or while the UUV is docked with the subsea station. At the subsea station, a quantity of buoyancy-adjustment material onboard the UUV is varied to correct the measured buoyancy drift by transferring that material from the subsea station to the UUV, or from the UUV to the subsea station or to the water. For example, a variable-buoyancy system of the UUV may be fluidly coupled to one or more tanks of buoyancy-adjustment material held at the subsea station, whereby the variable-buoyancy system is filled with that material or emptied of that material until the buoyancy drift is corrected. Then, the UUV is undocked from the subsea station and the mission is continued or resumed.

Thus, the invention involves assessing buoyancy drift of a UUV whose depth is controlled by permanent buoyancy and vertically-acting thrusters.

The invention takes advantage of a subsea station such as a basket or dock as a place where the buoyancy of a UUV can be adjusted, for example by being topped up with positively-buoyant flotation material or negatively-buoyant ballast material. The UUV may, for example, determine how much buoyancy-adjustment material it needs to take on or expel by calculating the residual thrust required to maintain a constant depth.

The buoyancy-adjustment material serving as a buoyancy element may be a granular solid material, a liquid or a gas. Examples are a liquid flotation material such as oil or a granular or particulate ballast material such as pellets of metal. More generally, the buoyancy-adjustment material may be ballast that is negatively buoyant in seawater, in which case that material flows downwardly from the subsea station to the UUV or from the UUV to the subsea station when varying the quantity of buoyancy-adjustment material onboard the UUV. Alternatively, the buoyancy-adjustment material may be flotation that is positively buoyant in seawater, in which case that material flows upwardly from the subsea station to the UUV or from the UUV to the subsea station when varying the quantity of buoyancy-adjustment material onboard the UUV.

Conveniently, during transfer to or from the UUV, the buoyancy-adjustment material is allowed to flow in a vertical direction determined by a difference in density between that material and the surrounding water. Thus, when docking the UUV with the subsea station, alignment may be effected on a vertical axis between a buoyancy-adjustment material inlet of the UUV and a buoyancy-adjustment material outlet of the subsea station. Alternatively, alignment may be effected on a vertical axis between a buoyancy-adjustment material outlet of the UUV and a buoyancy-adjustment material inlet of the subsea station.

Buoyancy drift may be measured in various ways. For example, an abnormal additional vertical thrust value required to keep the UUV at a constant depth may be recorded. In another technique, the period of time required to move the UUV between different reference water depths is measured and compared with a reference time period for moving the UUV between the same reference water depths under the same level of thruster power. In other words, vertical speed and vertical thruster power for swimming the UUV between two reference water depths are measured, and buoyancy drift is calculated by comparing the rate of depth change against a pre-existing reference value.

Another approach to measuring buoyancy drift is to measure and record, at a first instant, a first or preliminary value of thruster power required to keep the UUV at a selected reference water depth. Then, after using the UUV for a period of time to perform part of a mission, the UUV is returned to the reference water depth if necessary. There, at a second instant, a second value of thruster power required to keep the UUV at the reference water depth is measured and compared with the first value to calculate buoyancy drift over that period. The UUV may be substantially neutrally buoyant at the reference water depth when measuring the first value of thruster power, in which case the first value of thruster power may be substantially zero.

Preferably, a signal indicative of the measured buoyancy drift is sent from the UUV to the subsea station. That signal may be transmitted through the water. Advantageously, the UUV measures buoyancy drift and transmits the signal to the subsea station automatically. This may be triggered by an auto-diagnostic routine implemented onboard the UUV or in accordance with a schedule pre-programmed into the UUV.

It is also possible to measure buoyancy drift of the UUV while the UUV is docked with the subsea station. For example, vertical force exerted by the docked UUV on the subsea station may be measured while the UUV's thrusters exert no vertical thrust. In those circumstances, the vertical force resisted by the subsea station represents positive or negative buoyancy of the UUV as the case may be.

After docking the UUV with the subsea station, the buoyancy-adjustment material is transferred in an amount corresponding to the measured buoyancy drift. Advantageously, the quantity of buoyancy-adjustment material onboard the UUV is adjusted autonomously without commands from surface support.

The inventive concept embraces a subsea buoyancy adjustment system for a UUV and a UUV having such a buoyancy-adjustment system. The system comprises: an onboard tank for holding a variable quantity of a flowable buoyancy-adjustment material; and upwardly-opening and downwardly-opening passageways communicating with the onboard tank for transferring the buoyancy-adjustment material to or from the UUV.

Preferably, the system further comprises a calculation subsystem configured to calculate buoyancy drift of the UUV and to record a buoyancy drift value that is indicative of the calculated buoyancy drift. The calculation subsystem may comprise: a depth sensor configured to sense water depth; a timer configured to measure a time period required to move the UUV between different reference water depths under thruster power; and a memory configured to store a reference time period for moving the UUV between the reference water depths under the same thruster power. Alternatively, the calculation subsystem may comprise: a depth sensor configured to sense water depth; a thrust sensor configured to measure thruster power; and a memory configured to store a value of thruster power required to keep the UUV at a reference water depth.

The system suitably also comprises a transfer subsystem configured to transfer an amount of buoyancy-adjustment material in accordance with the buoyancy drift value. The transfer subsystem suitably comprises a valve in at least one of said passageways for controlling flow of the buoyancy-adjustment material into or out of the onboard tank.

Thus, the buoyancy adjustment system may comprise a means for calculating and recording buoyancy drift; communication means for sending the recorded value of buoyancy drift to a subsea station; and a ballast circuit containing a buoyancy element and comprising a port connectable to a buoyancy element tank of the subsea station for purge or refill for compensating buoyancy drift, when the UUV is docked to the subsea station.

The inventive concept extends to a subsea station that is preferably situated on the seabed. The station comprises: a dock for docking a UUV; at least one holding tank for holding a flowable buoyancy-adjustment material; and at least one upwardly-opening or downwardly-opening passageway aligned with the dock and communicating with the or each holding tank for transferring the buoyancy-adjustment material to or from the docked UUV.

The subsea station of the invention preferably further comprises a receiving system configured to receive a signal from the UUV representing a buoyancy drift value. The receiving system may be configured to receive that signal transmitted through water between the UUV and the subsea station before or after docking, or to receive that signal by contact with the docked UUV.

The subsea station of the invention preferably further comprises a transfer system configured to transfer an amount of buoyancy-adjustment material in accordance with a buoyancy drift value received from or measured from the UUV. The transfer system suitably comprises a valve in at least one of said passageways for controlling flow of the buoyancy-adjustment material into or out of the holding tank.

Thus, the subsea station may comprise: a dock for docking a UUV; communication means for receiving from the UUV a value of buoyancy to be compensated; at least one buoyancy element tank; at least one fluid interface between the at least one buoyancy element tank and a port of the UUV when the UUV is docked; and at least one controlled valve for transferring a required quantity of the buoyancy element from the UUV to the buoyancy element tank or from the buoyancy element tank to the UUV, that quantity corresponding to the value of buoyancy to be compensated as sent by the UUV.

The inventive concept also covers a subsea installation comprising the subsea station of the invention.

In order that the invention may be more readily understood, reference will now be made, by way of example, to the accompanying drawings in which:

FIGS. 1*a* to 1*c* are a series of schematic side views of an AUV measuring buoyancy drift over the course of a subsea mission, in accordance with a method of the invention;

Figure 1A:
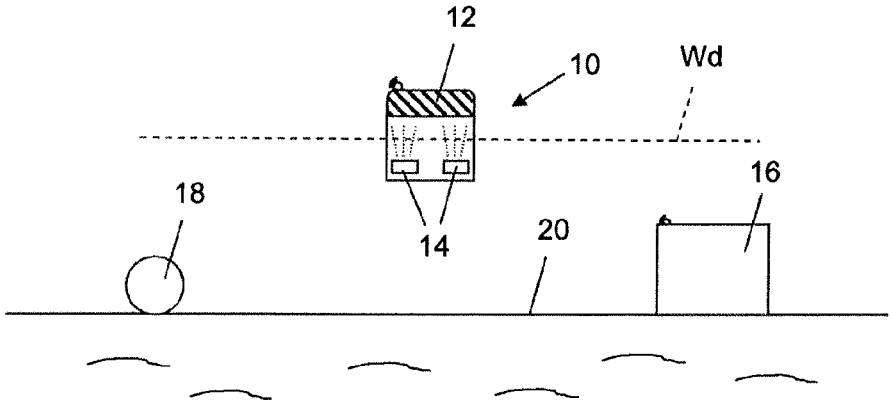
Figure 1B:
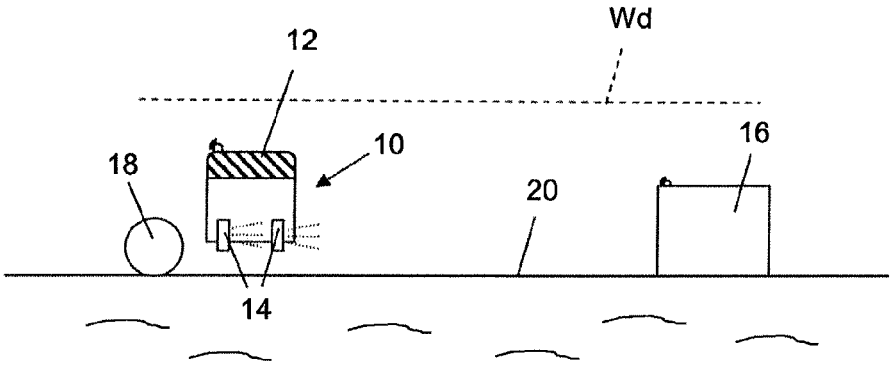
Figure 1C:
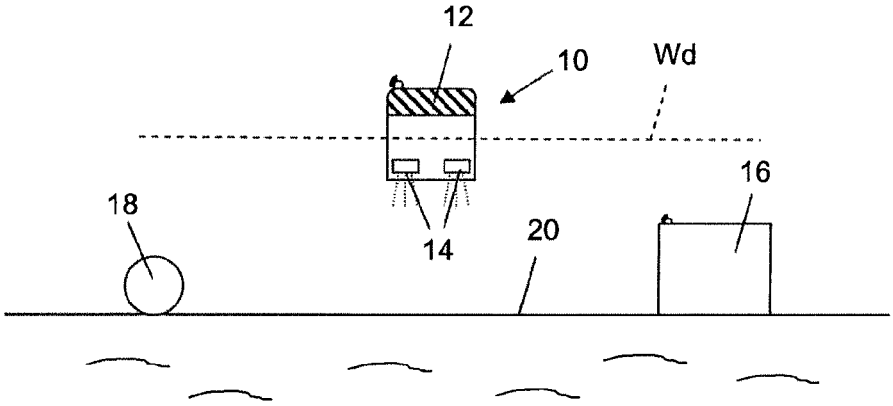

Referring firstly to FIGS. 1*a* to 1*c*, a UUV exemplified here as an AUV 10 is shown underwater measuring its buoyancy drift during the course of a subsea mission. The AUV 10 comprises permanent buoyancy 12 such as blocks of syntactic foam and is fitted with thrusters 14 that are pivotable about a horizontal axis to direct their thrust as required for movement of the AUV 10 in the x-, y- and z-axes. Alternatively, distinct thrusters may propel the AUV 10 on the x-, y- and z-axes.

During the mission, the AUV 10 also interacts with a subsea station 16 and a subsea worksite 18. In this example, both the station 16 and the worksite 18 rest on the seabed 20.

The worksite 18 is shown schematically as a subsea pipeline in FIGS. 1*a* to 1*c*. However, a worksite could be any subsea structure positioned on or above the seabed 20, or indeed could be the seabed 20 itself. The AUV 10 and the station 16 are shown in more detail in FIGS. 7 to 10 of the drawings.

In accordance with the invention, the AUV 10 returns to the station 16 periodically between tasks performed at one or more worksites 18 for correction of buoyancy drift. Conveniently, but optionally, the AUV 10 may also recharged or reprogrammed when at the station 16. However, recharging or reprogramming could instead take place at a different subsea station.

Figure 2:
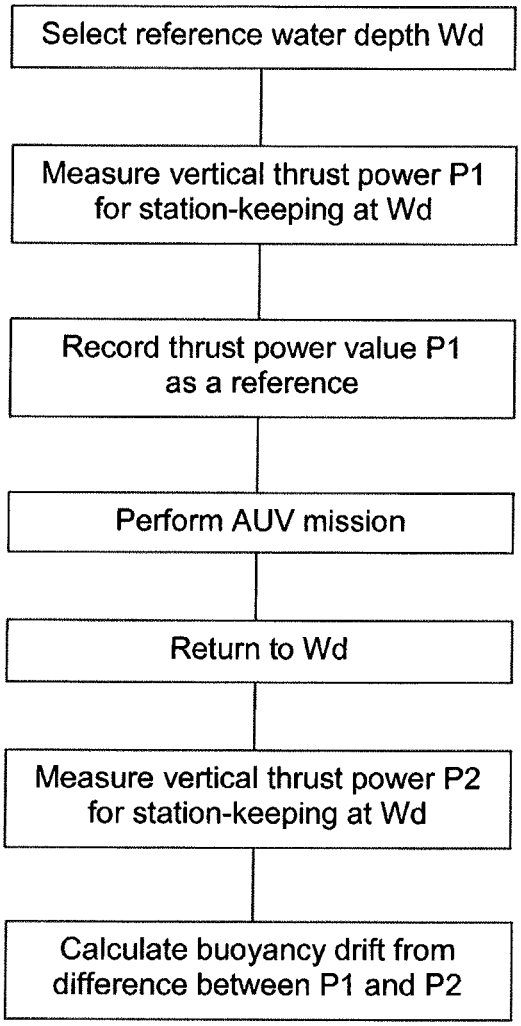
FIG. 2 is a flow diagram of the method shown in FIGS. 1*a* to 1*c;*

Clearly, buoyancy drift must be measured before it can be corrected. In this respect, the AUV 10 can measure its own buoyancy drift. For this purpose, with reference now also to the flow diagram of FIG. 2, the AUV 10 is flown to a reference water depth Wd close to the depth of the worksite 18 as shown in FIG. 1*a*. This is to obtain a reference indication of buoyancy of the AUV 10.

Once the AUV 10 is at Wd, the AUV 10 operates its thrusters 14, if necessary, to hold itself at Wd against the upward or downward force of its positive or negative buoyancy. Thus, the thrusters 14 are turned to direct their thrust vertically, that is, upwardly or downwardly depending upon whether the AUV 10 has positive or negative buoyancy. The power P1 and direction (up or down) of the thrusters 14 necessary to hold the AUV 10 at Wd is recorded by a memory onboard the AUV 10.

By way of example, FIG. 1*a* shows the thrusters 14 thrusting the AUV 10 down against the upward force of slightly positive buoyancy of the AUV 10. If the AUV 10 instead had slightly negative buoyancy, the thrusters 14 would instead thrust the AUV 10 up against the downward force of that buoyancy to hold the AUV 10 at Wd. Of course, if the AUV 10 was neutrally buoyant at Wd, then the thrusters 14 would not need to operate to hold the AUV 10 at Wd. P1 would then be zero.

Next, the AUV 10 leaves Wd to swim to its next destination during the subsea mission. By way of example, FIG. 1*b* shows the thrusters 14 of the AUV 10 turned to thrust horizontally so as to swim the AUV 10 over the seabed 20 to perform a task at the worksite 18. The AUV 10 may then stay at the worksite 18 for an extended period, continue to other worksites 18 or return to a subsea station 16 for recharging or reprogramming. Indeed, all of these possibilities are likely to take place repeatedly during an extended subsea mission.

Over a long period underwater, the inherent buoyancy of the AUV 10 will tend to drift, for example as the permanent buoyancy 12 creeps under continuous hydrostatic pressure. Shrinkage of the permanent buoyancy 12 due to creep will tend to reduce positive buoyancy of the AUV 10; indeed, it may tip the AUV 10 into slightly negative buoyancy if it was previously slightly positively buoyant.

To correct buoyancy drift, a buoyancy correction procedure may be triggered by an auto-diagnostic routine implemented onboard the AUV 10, for example if a controller onboard the AUV 10 detects that a consistently unusual level of vertically-directed thruster power is needed to hold station at a desired depth. Alternatively, a buoyancy correction procedure may be triggered at one or more predetermined times during the subsea mission in accordance with a schedule pre-programmed into the AUV 10.

Once triggered, the buoyancy correction procedure involves the AUV 10 returning to the reference water depth Wd as shown in FIG. 1*c*. Once the AUV 10 is back at Wd, the AUV 10 again turns the thrusters 14 to direct their thrust vertically. The thrusters 14 are operated, as necessary, to hold the AUV 10 at Wd against the upward or downward force of its positive or negative buoyancy. By way of example, FIG. 1*c* shows the thrusters 14 thrusting the AUV 10 up against the downward force of what is now slightly negative buoyancy, to hold the AUV 10 at Wd. The power P2 and direction (up or down) of the thrusters 14 necessary to hold the AUV 10 at Wd is recorded on board the AUV 10.

A controller onboard the AUV 10 compares P1 and P2, also having regard to whether thrust was directed upwardly or downwardly when P1 and P2 were measured. Differences in these parameters are used to determine the degree of buoyancy drift since the P1 was measured.

Figure 3:
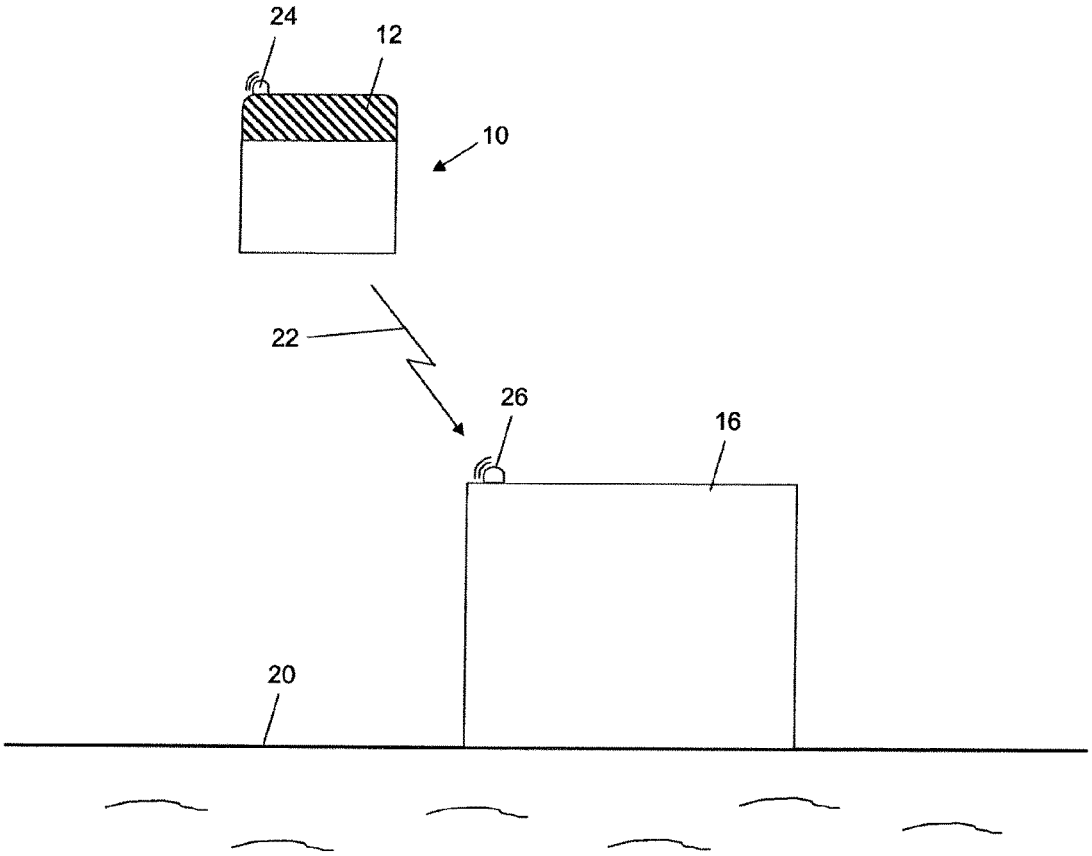
FIG. 3 is a schematic side view of an AUV communicating buoyancy drift data to a subsea station before docking with that station to correct the buoyancy drift in accordance with the invention.

FIG. 3 shows the AUV 10 sending a data signal 22 to the station 16, which signal 22 represents the degree of buoyancy drift of the AUV 10. For this purpose, the AUV 10 and the station 16 are fitted with transponders 24, 26 respectively for data communication through the water that surrounds them. The signal 22 may be sent via the transponders 24, 26 before the AUV 10 docks with the station 16, as shown in FIG. 3, or after the AUV 10 docks with the station 16.

Figure 4:
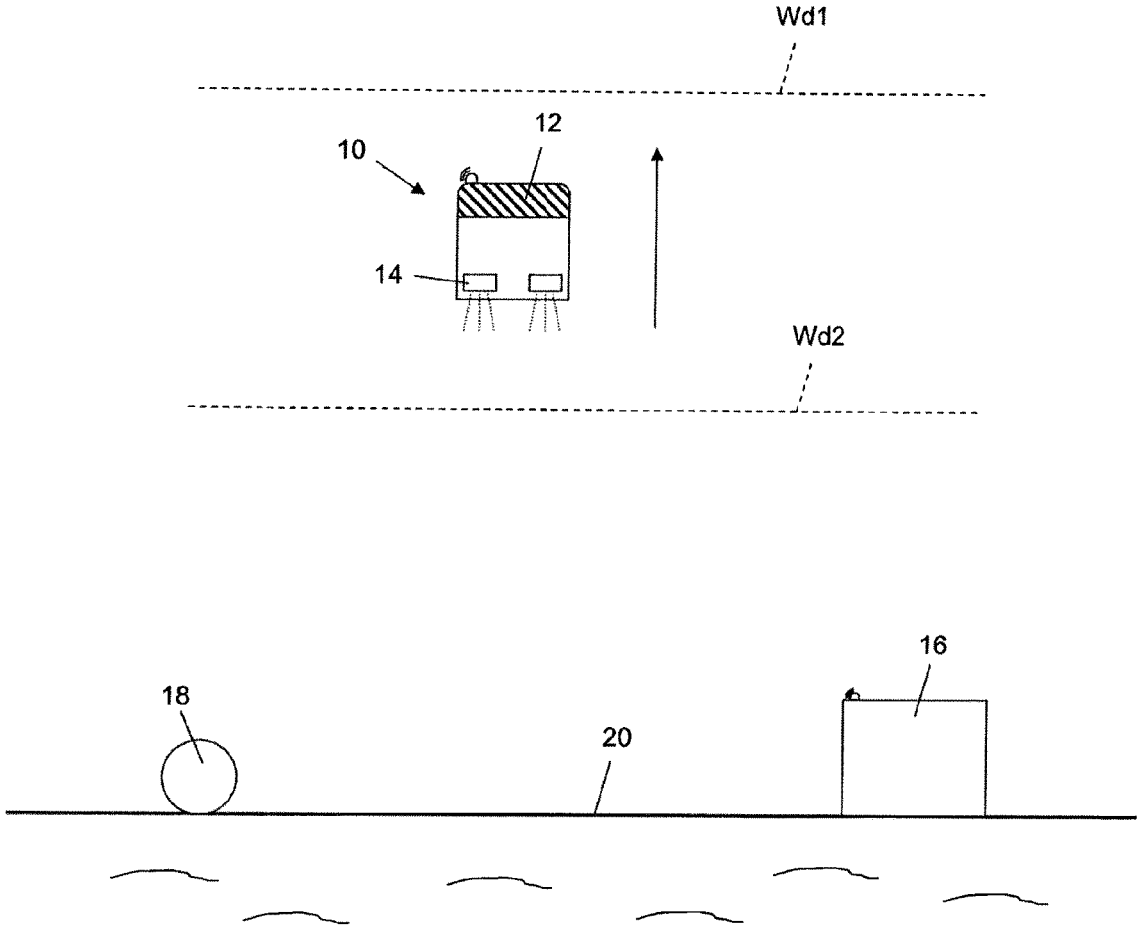
FIG. 4 is a schematic side view of an AUV measuring buoyancy drift during a subsea mission, in accordance with another method of the invention.
Figure 5:
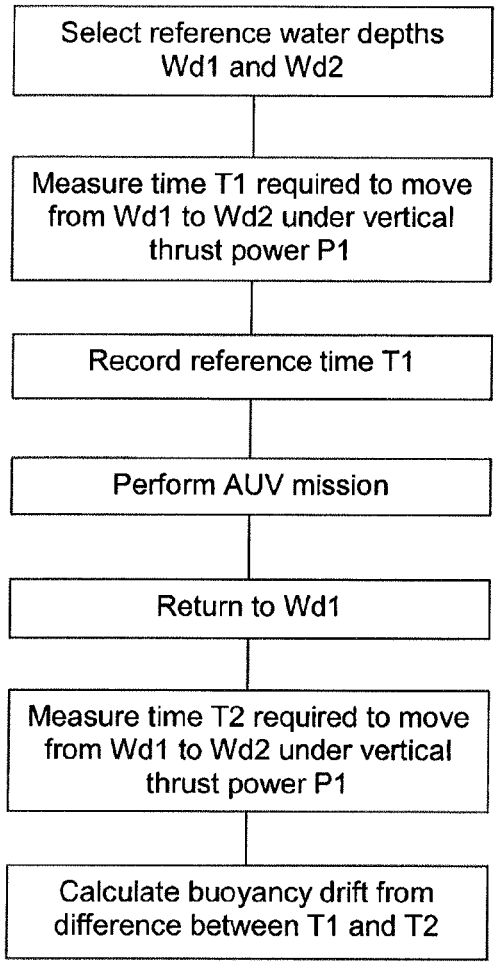
FIG. 5 is a flow diagram of the method shown in FIG. 4.

FIGS. 4 and 5 show another way of measuring buoyancy drift during a subsea mission in accordance with the invention. Like numerals are used for like parts in FIG. 4. FIG. 5 is a corresponding flow diagram.

In FIG. 4, the AUV 10 is shown measuring a reference period of time, T1, required to swim itself vertically between different reference water depths Wd1, Wd2 by virtue of a reference thrust level exerted vertically through its thrusters 14. The reference thrust level may be inferred from the power consumption of the thrusters 14. Once T1 and the reference thrust level are stored onboard the AUV 10, the AUV 10 swims to its next destination during the subsea mission, for example to perform a task at the worksite 18.

When a buoyancy correction procedure is triggered, again by an auto-diagnostic routine or in accordance with a pre-programmed schedule, the AUV 10 returns to Wd1. The AUV 10 then again swims itself vertically between Wd1 and Wd2, exerting the reference thrust level through its thrusters 14. The time T2 taken to travel between Wd1 and Wd2 is recorded and a controller onboard the AUV 10 compares T1 and T2. The value of any difference between T1 and T2 is used to determine the degree of buoyancy drift since T1 was measured.

Figure 6:
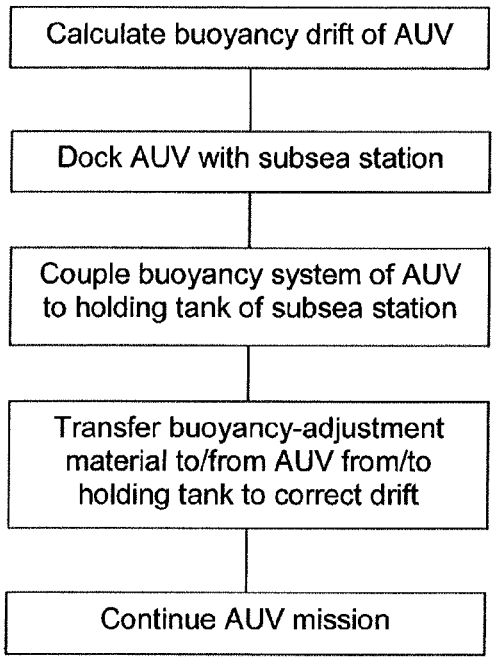
FIG. 6 is a flow diagram of a method for correcting buoyancy drift involving docking the AUV with the subsea station shown in FIGS. 1*a* to 1*c*, 3 and 4.

The remaining drawings show how buoyancy drift of the AUV 10 can be corrected once measured. Specifically, FIG. 6 is a flow diagram of a method for correcting buoyancy drift by docking the AUV 10 with the subsea station 16. FIGS. 7 to 10 show the method being performed after the AUV 10 has been docked with the station 16. Thus connected, the AUV 10 and the station 16 interact as parts of a buoyancy-correction system in accordance with the invention.

The method set out in FIG. 6 involves coupling a buoyancy system of the docked AUV 10 to one or more holding receptacles or tanks of the station 10. Coupling does not require a physical connection to be made between inlets or outlets of the AUV 10 and the station 16: advantageously, as shown, coupling simply involves aligning such inlets and outlets on a vertical axis, which alignment may be effected simply by the act of docking the AUV 10 with the station 16. Then, the buoyancy drift is corrected by transferring an appropriate amount of a buoyancy-adjustment material to the AUV 10 from a holding receptacle of the station 10 or from the AUV 10 to a holding receptacle of the station 10.

In principle, it would be possible to transfer buoyancy-adjustment material from the AUV 10 to the seabed 20 or into the surrounding seawater. However, this option is not preferred unless the buoyancy-adjustment material is environmentally inert or is otherwise apt to be released into the subsea environment.

The buoyancy-adjustment material is a flowable, fluid mass that is preferably a liquid or behaves, in bulk, substantially as a liquid, such as a granular, particulate, pelletised or fragmentary mass or aggregation of solid grains or pellets. If the buoyancy-adjustment material is a liquid, preferably that liquid is substantially insoluble in, or immiscible with, sea water.

The buoyancy-adjustment material has a relative density or specific gravity that is substantially different to that of sea water; either substantially lower, so as to be positively buoyant in sea water as flotation material or substantially higher, so as to be negatively buoyant in sea water as ballast material. Conveniently, therefore, the buoyancy-adjustment material flows upwardly or downwardly during transfer to or from the AUV 10 by virtue of the positive or negative buoyancy of that material in sea water. This means that there is no need to pump the buoyancy-adjustment material to drive the flow, although pumping or other impulsion of that material is possible; instead, the buoyancy-adjustment material merely needs to be released to allow it to flow.

Figure 7:
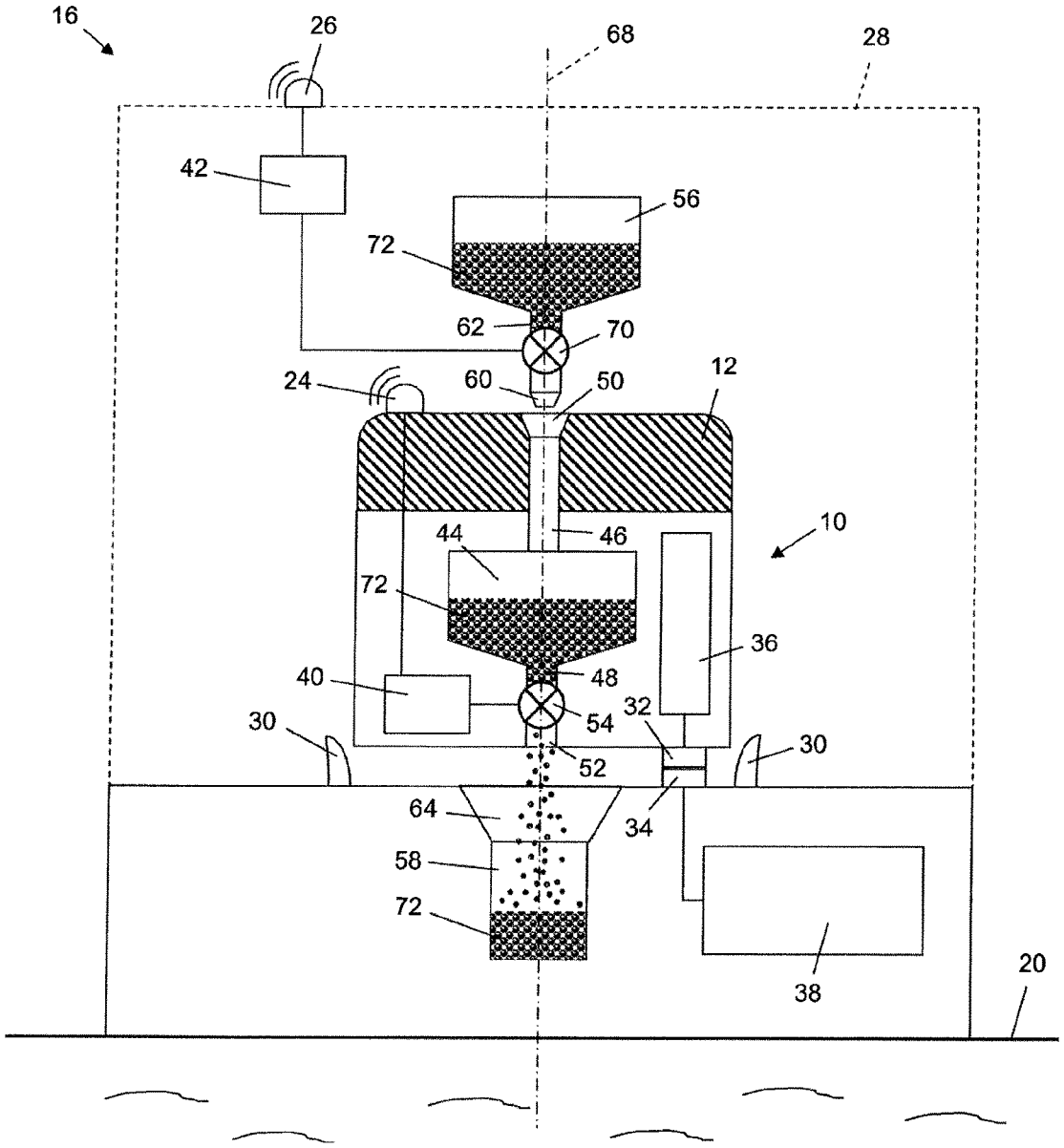
FIG. 7 is a part-sectional side view of an AUV docked with a subsea station at which ballast material is transferred from the AUV to correct excessive negative buoyancy of the AUV.
Figure 8:
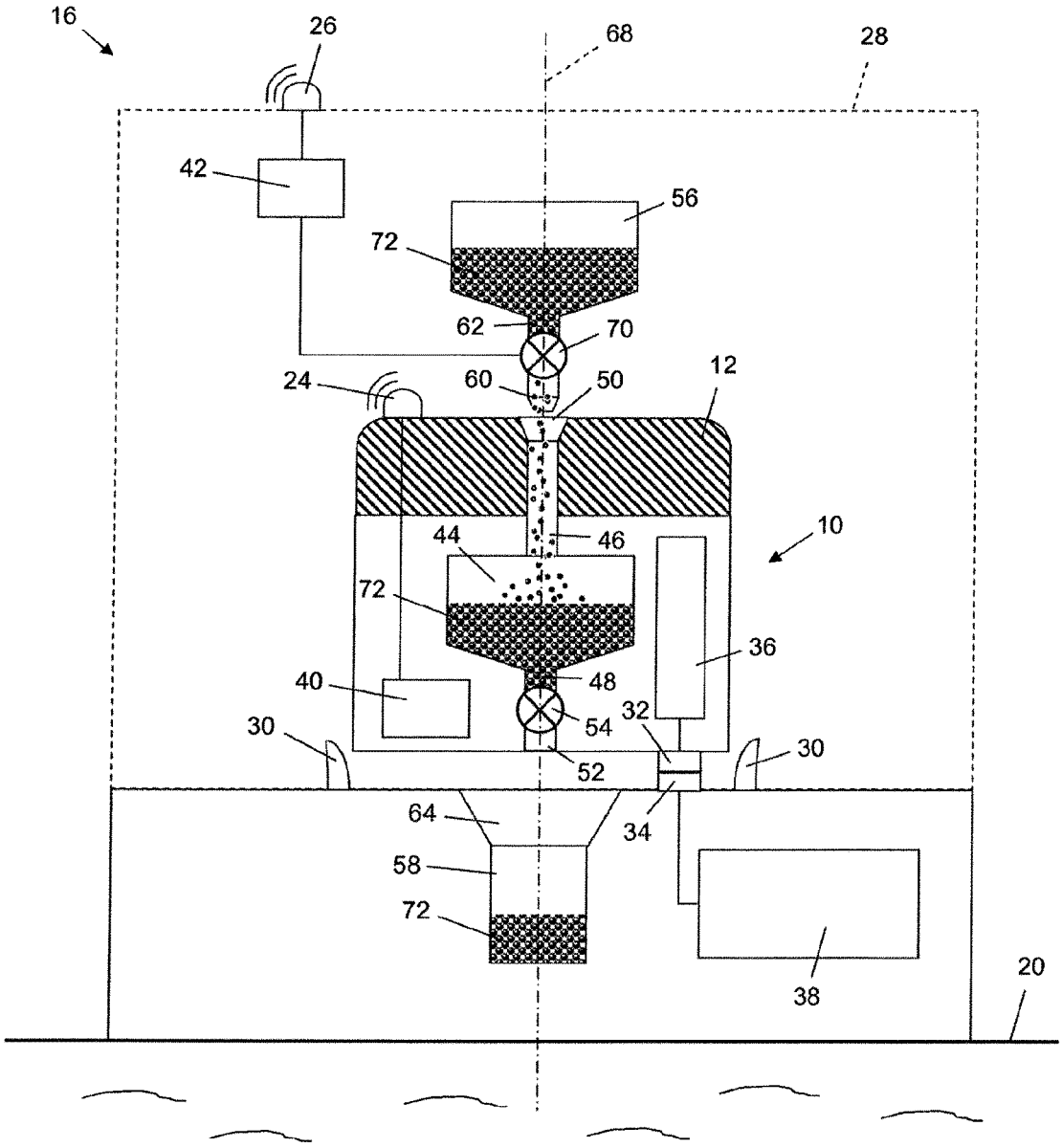
FIG. 8 is a part-sectional side view of an AUV docked with a subsea station at which ballast material is transferred to the AUV to correct excessive positive buoyancy of the AUV.
Figure 9:
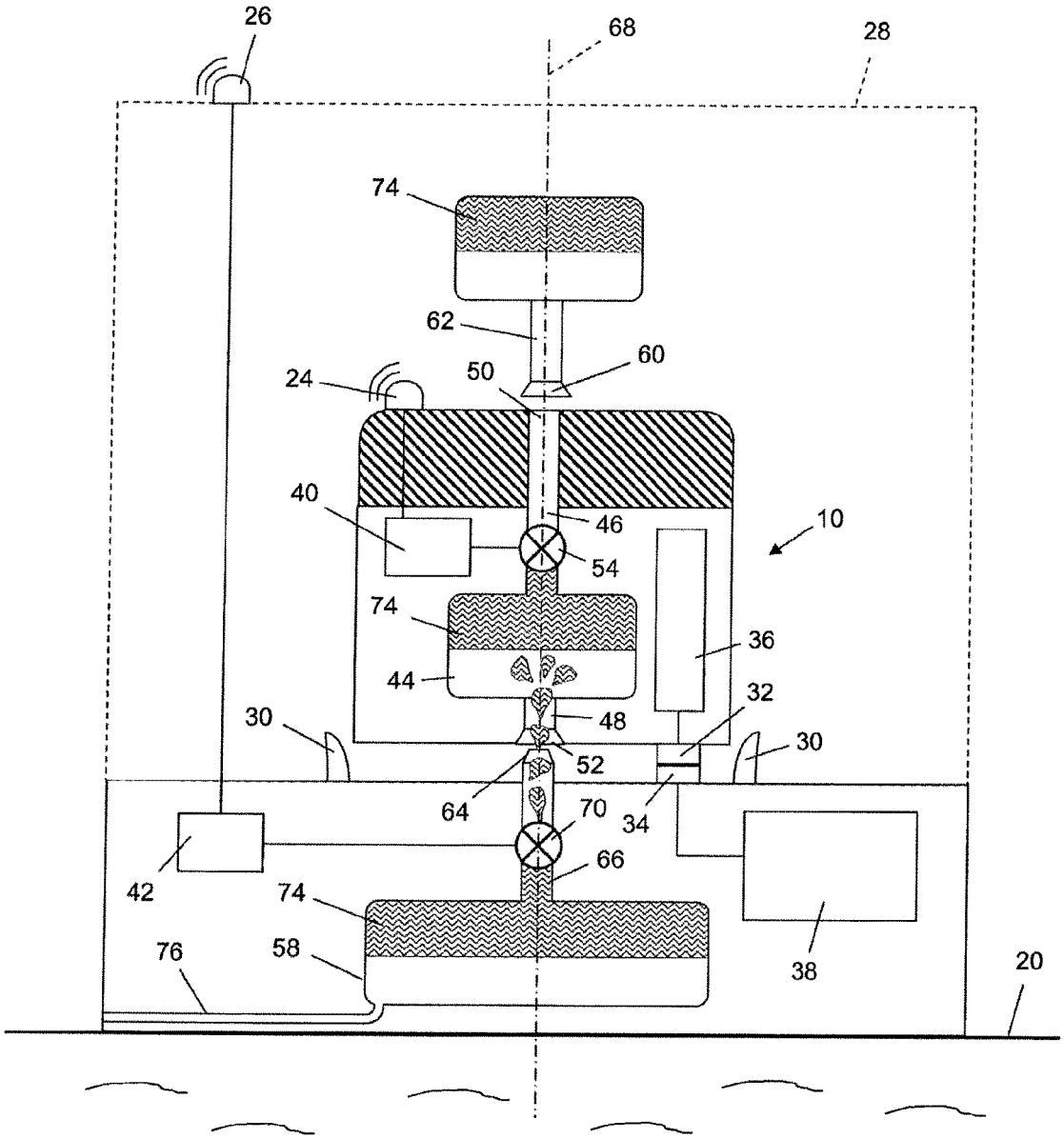
FIG. 9 is a part-sectional side view of an AUV docked with a subsea station at which flotation material is transferred to the AUV to correct excessive negative buoyancy of the AUV.
Figure 10:
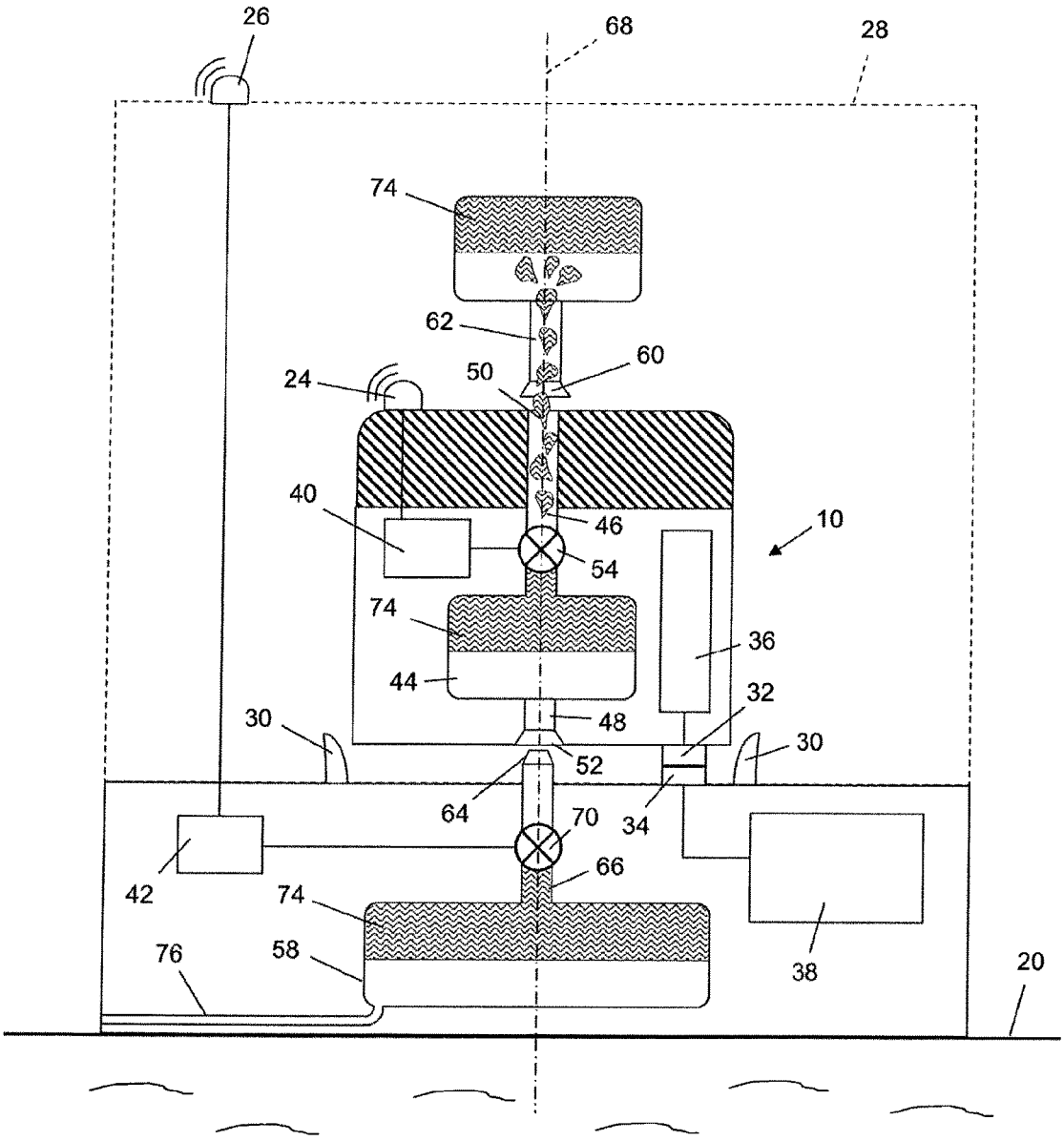
FIG. 10 is a part-sectional side view of an AUV docked with a subsea station at which flotation material is transferred from the AUV to correct excessive positive buoyancy of the AUV.

FIGS. 7 and 8 show a first embodiment of the invention whereas FIGS. 9 and 10 show a second embodiment of the invention; like numerals are used for like parts. In these exemplary embodiments, the subsea station 16 has facilities for recharging or reprogramming the AUV 10. However such facilities are not essential: in principle, the station 16 could be configured simply for buoyancy correction.

The first and second embodiments have several features in common that will be described first in the interest of brevity. In each embodiment, the AUV 10 is shown having been guided into a dock 28 of the subsea station 16 by converging guide formations 30 to align and couple first and second wet-mating connector parts 32, 34 of the AUV 10 and the station 16 respectively.

The first connector part 32 is connected to an electrical power system 36 onboard the AUV 10 to recharge batteries of the power system 36. The complementary second connector part 34 is connected to an electrical power source 38 in the station 16, from which the power system 36 of the AUV 10 draws electrical power through the wet-mated connector parts 32, 34.

In corresponding manner, data may pass via the wet-mated connector parts 32, 34 in either direction between the AUV 10 and the station 16. Alternatively, data may pass via the transponders 24, 26 in either direction through the water between the AUV 10 and the station 16. In this respect, the transponders 24, 26 can emit and/or receive underwater signals. This latter possibility is shown in FIGS. 7 to 10, where it will be noted that the transponders 24, 26 send data to, and receive data from, respective controllers 40, 42, namely a controller 40 onboard the AUV 10 and a controller 42 in the station 16. Such data includes control data whereby the controllers 40, 42 interact and synchronise the actions of associated valves to implement the buoyancy-correction system of the invention. Such data may also be used for downloading diagnostic information from the AUV 10 or for uploading new programming to the AUV 10.

In FIGS. 7 to 10, the AUV 10 has an onboard buoyancy tank 44 for holding a variable quantity of a buoyancy-adjustment material. The buoyancy-correction system of the invention controls the quantity of the buoyancy-adjustment material in the buoyancy tank 44 to correct buoyancy drift of the AUV 10.

Passageways 46, 48 in the AUV 10 communicate with the buoyancy tank 44 for transferring the buoyancy-adjustment material to or from the AUV 10. The passageways 46, 48 are an upwardly-extending passageway 46 that terminates in an upwardly-facing opening 50 on the top side of the AUV 10 and a downwardly-extending passageway 48 that terminates in a downwardly-facing opening 52 on the underside of the AUV 10. The flow of buoyancy-control material out of the buoyancy tank 44 along at least one of the passageways 46, 48 is controlled by a valve 54 whose opening and closing is controlled by the controller 40 onboard the AUV 10.

In the examples shown in FIGS. 7 to 10, the subsea station 16 has two holding receptacles 56, 58, namely an upper receptacle 56 and a lower receptacle 58. The upper receptacle 56 communicates with a downwardly-facing opening 60 above the dock 28 through an upper passageway 62 that extends downwardly from the upper receptacle 56. In an alternative arrangement, the downwardly-facing opening 60 could instead communicate directly with the upper receptacle 56 without an upper passageway 62 between them. Thus, the downwardly-facing opening 60 could be provided in the bottom of the upper receptacle 56.

An upwardly-facing opening 64 beneath the dock 28 communicates with the lower receptacle 58. In the first embodiment shown in FIGS. 7 and 8, the upwardly-facing opening 64 communicates directly with the lower receptacle 58. Thus, the upwardly-facing opening 64 is provided at the top of the lower receptacle 58. Conversely, in the second embodiment shown in FIGS. 9 and 10, the upwardly-facing opening 64 communicates indirectly with the lower receptacle 58 via a lower passageway 66 that extends upwardly from the lower receptacle 58.

When the AUV 10 is docked in the dock 28 of the subsea station 16, the upwardly-facing opening 50 on the top side of the AUV 10 substantially aligns on a vertical axis 68 beneath the downwardly-facing opening 60 that communicates with the upper receptacle 56. Similarly, the downwardly-facing opening 52 on the underside of the AUV 10 substantially aligns on the vertical axis 68 above the upwardly-facing opening 64 that communicates with the lower receptacle 58. With the openings 50, 52, 60, 64 thus aligned with their counterparts, the buoyancy-control material can flow from the buoyancy tank 44 of the AUV 10 into the upper or lower receptacles 56, 58 or from the upper or lower receptacles 56, 58 into the buoyancy tank 44 of the AUV 10.

The flow of buoyancy-control material out of at least one of the upper or lower receptacles 56, 58 is controlled by a valve 70 in the associated upper or lower passageway 62, 66, whose opening and closing is controlled by the controller 42 in the station 16.

Having now described the main similarities between the first and second embodiments, key differences between them will be described next.

In the first embodiment shown in FIGS. 7 and 8, the buoyancy-adjustment material is a ballast material 72 that is negatively buoyant in seawater. Here, the ballast material 72 is exemplified as a mass of metal pellets such as ball bearings. Thus, during transfer, the ballast material 72 flows downwardly through the surrounding water from the subsea station 16 to the AUV 10 or from the AUV 10 to the station 16.

It follows that in FIGS. 7 and 8, the upper receptacle 56 is a supplying receptacle for supplying ballast material 72 to the buoyancy tank 44 of the AUV 10 and the lower receptacle 58 is a receiving receptacle for receiving ballast material 72 from the buoyancy tank 44 of the AUV 10. Thus, the upper and lower receptacles 56, 58 and the buoyancy tank 44 are, or may be, open-topped hoppers. It also follows that the downward flow of ballast material 72 from the upper receptacle 56 and from the buoyancy tank 44 is controlled by valves 70, 54 positioned, respectively, in the upper passageway 62 beneath the upper receptacle 56 and in the downwardly-extending passageway 48 beneath the buoyancy tank 44.

FIG. 7 shows the AUV 10 offloading ballast material 72 to lighten itself, hence correcting excessive negative buoyancy. This is achieved by opening the valve 54 in the downwardly-extending passageway 48 beneath the buoyancy tank 44, which allows an amount of ballast material 72 to fall through the water from the downwardly-facing opening 52 on the underside of the AUV 10 and into the lower receptacle 58 via the opposed aligned upwardly-facing opening 64. The valve 54 is opened for a variable period of time necessary to release an appropriate quantity of ballast material 72 from the AUV 10.

FIG. 8 shows the AUV 10 taking on ballast material 72 to become heavier, hence correcting excessive positive buoyancy. This is achieved by opening the valve 70 in the upper passageway 62 beneath the upper receptacle 56, which allows an amount of ballast material 72 to fall through the water from the downwardly-facing opening 60 and into the buoyancy tank 44 via the opposed aligned upwardly-facing opening 50 on the top side of the AUV 10. Again, the valve 70 is opened for a variable period of time necessary to release an appropriate quantity of ballast material 72 into the AUV 10.

In the second embodiment shown in FIGS. 9 and 10, the buoyancy-adjustment material is a flotation material 74 that is positively buoyant in seawater. Here, the flotation material 74 is exemplified as a body of light liquid, namely an oil such as diesel oil, which is substantially insoluble in, and immiscible with, sea water. Thus, during transfer, the flotation material 74 flows upwardly from the subsea station 16 to the AUV 10 or from the AUV 10 to the station 16.

It follows that in FIGS. 9 and 10, the lower receptacle 58 is a supplying receptacle for supplying flotation material 74 to the buoyancy tank 44 of the AUV 10 and the upper receptacle 56 is a receiving receptacle for receiving flotation material 74 from the buoyancy tank 44 of the AUV 10. Thus, the upper and lower receptacles 56, 58 and the buoyancy tank 44 are, or may be, open-bottomed tanks. It also follows that the upward flow of flotation material 74 from the lower receptacle 58 and from the buoyancy tank 44 is controlled by valves 70, 54 positioned, respectively, in the lower passageway 66 above the lower receptacle 58 and in the upwardly-extending passageway 46 above the buoyancy tank 44.

FIG. 9 shows the AUV 10 taking on flotation material 74 to lighten itself, hence correcting excessive negative buoyancy. This is achieved by opening the valve 70 in the lower passageway 66 above the lower receptacle 58, which allows an amount of flotation material 74 to rise through the water from the upwardly-facing opening 64, through the opposed aligned downwardly-facing opening 50 on the underside of the AUV 10 and into the buoyancy tank 44. The valve 70 is opened for a variable period of time necessary to release an appropriate quantity of flotation material 74 into the AUV 10.

As flotation material 74 is released from the lower receptacle 58, a corresponding volume of sea water flows in to the lower receptacle 58 through a pipe 76. In turn, the flotation material 74 thus transferred to the AUV 10 displaces a corresponding volume of sea water in the buoyancy tank 44 downwardly through the open bottom of the buoyancy tank 44.

Finally, FIG. 10 shows the AUV 10 offloading flotation material 74 to become heavier, hence correcting excessive positive buoyancy. This is achieved by opening the valve 54 in the upwardly-extending passageway 46 above the buoyancy tank 44, which allows an amount of flotation material 74 to rise through the water from the upwardly-facing opening 50 on the top side of the AUV 10 and into the upper receptacle 56 via the opposed aligned downwardly-facing opening 60. The valve 54 is opened for a variable period of time necessary to release an appropriate quantity of flotation material 74 from the AUV 10. The flotation material 74 transferred to the upper receptacle 56 displaces a corresponding volume of sea water downwardly through the open bottom of the upper receptacle 56.

Many variations are possible within the inventive concept. For example, the invention could also be extended to the delivery of tools or control pods, where the tool or pod is to be delivered to a location that has a buoyancy trim system available. It is also possible to use the invention in relation to ROV operations where buoyancy or trim needs to be adjusted.

Buoyancy-adjustment material could be pumped or otherwise recirculated at the subsea station 16 from the upper receptacle 56 to the lower receptacle 58 or vice-versa, depending upon which is the supplying receptacle and which is the receiving receptacle.

Receptacles 56, 58 could alternatively be located on the sides of the subsea station 16. Transfer of ballast material 72 or floatation material 74 may be achieved by pumping.

It is essential that buoyancy drift of the AUV 10 is determined at some point during the mission stages comprising swimming in the water, approaching the station 16, docking with the station 16 and adjusting buoyancy. However, it is not essential that buoyancy drift of the AUV 10 is determined before docking with the station 16. Nor is it essential that the AUV 10 determines its own buoyancy drift. For example, the station 16 may participate in determining buoyancy drift of the AUV 10 by measuring a buoyancy force exerted by the AUV 10 on the station 16 after docking.

Specifically, when the AUV 10 is docked with the station 16 and the thrusters 14 are inactive, intrinsic positive or negative buoyancy of the AUV 10 will exert an upward or downward force on the station 16. That force may be measured by one or more load cells between opposed docking points on the AUV 10 and the station 16, for example on one or more of the connector parts 32, 34. Thus, the controller 42 on the station 16 can receive a force signal from such a load cell, use that signal to infer the buoyancy condition of the AUV 10, and thereby control the buoyancy-correction system to correct any buoyancy drift accordingly. This buoyancy-checking routine may be run either on a pre-programmed schedule or whenever the AUV 10 is docked with the station 16.

In combination with the methods above, buoyancy drift of the AUV 10 can also involve attaching and/or lifting a payload or a clump weight by the AUV 10, for example for enhancing the accuracy of thrust power estimation. Thrust power levels required to lift the payload from the seabed at two different times may be compared.

The invention claimed is:

1. A method of adjusting buoyancy of a UUV during a subsea mission, the method comprising:

measuring buoyancy drift of the UUV when underwater;

docking the UUV with a subsea station;

at the subsea station, changing a quantity of a flowable buoyancy-adjustment material comprising a granular solid material, a liquid, or a gas, held onboard the UUV to correct the measured buoyancy drift by transferring that material from the subsea station to the UUV or from the UUV to the subsea station, wherein the buoyancy-adjustment material is a ballast material that is negatively buoyant in seawater, and wherein when varying the quantity of buoyancy-adjustment material onboard the UUV, said material flows downwardly from the subsea station to the UUV or from the UUV to the subsea station or to the water;

undocking the UUV from the subsea station; and continuing the mission.

2. A method of adjusting buoyancy of a UUV during a subsea mission, the method comprising:

measuring buoyancy drift of the UUV when underwater;

docking the UUV with a subsea station;

at the subsea station, changing a quantity of a flowable buoyancy-adjustment material comprising a granular solid material, a liquid, or a gas, held onboard the UUV to correct the measured buoyancy drift by transferring that material from the subsea station to the UUV or from the UUV to the subsea station, wherein the buoyancy-adjustment material is a flotation material that is positively buoyant in seawater and wherein varying the quantity of buoyancy-adjustment material onboard the UUV, said material flows upwardly from the subsea station to the UUV or from the UUV to the subsea station or to the water;

undocking the UUV from the subsea station; and continuing the mission.

3. The method of claim 1, comprising measuring buoyancy drift of the UUV before docking the UUV with the subsea station.

4. The method of claim 3, comprising measuring buoyancy drift by recording an abnormal additional vertical thrust value required to keep the UUV at a constant depth.

5. The method of claim 3, comprising measuring buoyancy drift by:

measuring a period of time required to move the UUV between different reference water depths by virtue of a level of thruster power; and comparing the measured time period with a reference time period for moving the UUV between the reference water depths under the same level of thruster power.

6. The method of claim 3, comprising measuring buoyancy drift by:

selecting a reference water depth for testing;

at the reference water depth, measuring and recording a first value of thruster power required to keep the UUV at the reference water depth;

using the UUV for a period of time to perform subsea tasks as part of the mission;

at the reference water depth, after said period, measuring a second value of thruster power required to keep the UUV at the reference water depth; and comparing the first and second values of thruster power to calculate buoyancy drift over said period.

7. The method of claim 6, wherein the UUV is substantially neutrally buoyant at the reference water depth when measuring the first value of thruster power.

8. The method of claim 7, wherein the first value of thruster power is zero.

9. The method of claim 1, comprising sending a signal from the UUV to the subsea station, which signal is indicative of the measured buoyancy drift.

10. The method of claim 9, comprising transmitting said signal through the water.

11. The method of claim 9, wherein the UUV measures buoyancy drift and transmits said signal to the subsea station automatically.

12. The method of claim 1, comprising measuring buoyancy drift of the UUV while the UUV is docked with the subsea station.

13. The method of claim 12, comprising measuring vertical force exerted by the docked UUV on the subsea station.

14. The method of claim 1, comprising, after docking the UUV with the subsea station, transferring the buoyancy-adjustment material in an amount corresponding to the measured buoyancy drift.

15. The method of claim 1, wherein the quantity of buoyancy-adjustment material onboard the UUV is adjusted autonomously without commands from surface support.

16. The method of claim 1, triggered by an auto-diagnostic routine implemented onboard the UUV.

17. The method of claim 1, triggered in accordance with a schedule pre-programmed into the UUV.

18. The method of claim 1, wherein the buoyancy-adjustment material is a liquid, a gas or of granular solids.

19. The method of claim 1, comprising, when docking the UUV with the subsea station, effecting alignment on a vertical axis between a buoyancy-adjustment material inlet of the UUV and a buoyancy-adjustment material outlet of the subsea station.

20. The method of claim 1, comprising, when docking the UUV with the subsea station, effecting alignment on a vertical axis between a buoyancy-adjustment material outlet of the UUV and a buoyancy-adjustment material inlet of the subsea station.

21. The method of claim 1, wherein, during transfer to or from the UUV, the buoyancy-adjustment material flows in a vertical direction determined by a difference in density between that material and the surrounding water.

22. A UUV comprising a subsea buoyancy adjustment system, the system comprising:

an onboard tank for holding a variable quantity of a flowable buoyancy-adjustment material, wherein the buoyancy-adjustment material is a liquid or a granular solid; and at least one upwardly-opening passageway communicating with the onboard tank for transferring the buoyancy-adjustment material to or from the UUV, the at least one passageway terminating in an upwardly-facing opening on a top side of the UUV.

23. The UUV of claim 22, further comprising a calculation subsystem configured to calculate buoyancy drift of the UUV and to record a buoyancy drift value that is indicative of the calculated buoyancy drift.

24. The UUV of claim 23, wherein the calculation subsystem comprises: a depth sensor configured to sense water depth; a timer configured to measure a time period required to move the UUV between different reference water depths under thruster power; and a memory configured to store a reference time period for moving the UUV between the reference water depths under the same thruster power.

25. The UUV of claim 23, wherein the calculation subsystem comprises: a depth sensor configured to sense water depth; a thrust sensor configured to measure thruster power; and a memory configured to store a value of thruster power required to keep the UUV at a reference water depth.

26. The UUV of claim 23, further comprising a sending subsystem configured to send a signal representing the recorded buoyancy drift value from the UUV to a subsea station.

27. The UUV of claim 26, wherein the sending subsystem is configured to transmit said signal through water between the UUV and the subsea station.

28. The UUV of claim 23, further comprising a transfer subsystem configured to transfer an amount of buoyancy-adjustment material in accordance with the buoyancy drift value.

29. The UUV of claim 28, wherein the transfer subsystem comprises a valve in at least one of said passageways for controlling flow of the buoyancy-adjustment material into or out of the onboard tank.

30. A subsea station comprising:

a dock for docking a UUV;

at least one holding tank for holding a flowable buoyancy-adjustment material, wherein the buoyancy-adjustment material is a liquid or a granular solid; and at least one upwardly-opening or downwardly-opening passageway aligned with the dock and communicating with the or each holding tank for transferring the buoyancy-adjustment material to or from the docked UUV.

31. The station of claim 30, further comprising a receiving system configured to receive a signal from the UUV representing a buoyancy drift value.

32. The station of claim 31, wherein the receiving system is configured to receive said signal transmitted through water between the UUV and the subsea station.

33. The station of claim 31, wherein the receiving system is configured to receive said signal by contact with the docked UUV.

34. The station of claim 30, further comprising a measuring system configured to measure a buoyancy drift value of the docked UUV.

35. The station of claim 34, wherein the measuring system is configured to measure vertical force exerted by the docked UUV on the subsea station.

36. The station of claim 30, further comprising a transfer system configured to transfer an amount of buoyancy-adjustment material in accordance with a buoyancy drift value received from or measured from the UUV.

37. The station of claim 36, wherein the transfer system comprises a valve in at least one of said passageways for controlling flow of the buoyancy-adjustment material into or out of the holding tank.

38. The station of claim 30, being situated at the seabed.

39. A subsea installation comprising the station of claim 30.

40. The method of claim 2, comprising measuring buoyancy drift of the UUV before docking the UUV with the subsea station.

41. The method of claim 40, comprising measuring buoyancy drift by recording an abnormal additional vertical thrust value required to keep the UUV at a constant depth.

42. The method of claim 40, comprising measuring buoyancy drift by:

measuring a period of time required to move the UUV between different reference water depths by virtue of a level of thruster power; and comparing the measured time period with a reference time period for moving the UUV between the reference water depths under the same level of thruster power.

43. The method of claim 40, comprising measuring buoyancy drift by:

selecting a reference water depth for testing;

at the reference water depth, measuring and recording a first value of thruster power required to keep the UUV at the reference water depth;

using the UUV for a period of time to perform subsea tasks as part of the mission;

at the reference water depth, after said period, measuring a second value of thruster power required to keep the UUV at the reference water depth; and comparing the first and second values of thruster power to calculate buoyancy drift over said period.

* * * * *